United States Patent [19]

Giros et al.

[11] 4,145,904

[45] Mar. 27, 1979

[54] BENDING AND HELIX-FORMING APPARATUS

[75] Inventors: Marcel A. Giros, Ancerville; Claude A. Venier, Saint Dizier, both of France

[73] Assignee: Societe Meusienne de Constructions Mechaniques, Ancerville, France

[21] Appl. No.: 833,880

[22] Filed: Sep. 16, 1977

[30] Foreign Application Priority Data

Mar. 28, 1977 [FR] France ..... 77 10018

[51] Int. Cl.[2] ..... B21F 3/04

[52] U.S. Cl. ..... 72/142; 72/145; 72/169; 72/465; 140/2

[58] Field of Search ..... 72/135, 142, 145, 148, 72/169, 166, 171, 172, 173, 465, 466; 140/2

[56] References Cited

U.S. PATENT DOCUMENTS

| | | | |
|---|---|---|---|
| 1,230,750 | 6/1917 | Menzer | 72/148 |
| 3,205,689 | 9/1965 | Joseph | 72/465 X |
| 3,279,234 | 10/1966 | Ames | 72/465 X |
| 3,444,716 | 5/1969 | Martin | 72/166 X |
| 3,899,911 | 8/1975 | Ogier et al. | 72/169 |

FOREIGN PATENT DOCUMENTS

| | | | |
|---|---|---|---|
| 241396 | 7/1965 | Australia | 140/2 |
| 46-4059 | 2/1971 | Japan | 72/148 |
| 1184380 | 3/1970 | United Kingdom | 72/148 |

*Primary Examiner*—E. M. Combs
*Attorney, Agent, or Firm*—Otto John Munz

[57] ABSTRACT

The invention relates to a bending or helix-forming apparatus operating by partial but continuous rolling of a long product on a resilient rim portion of a driven rotatable drum, to which portion it is applied by a plurality of rollers having axes parallel to that of the drum, with a pressure sufficient such that its adherence to the said resilient rim portion of the drum ensures that it is positively driven by the latter.

14 Claims, 10 Drawing Figures

BENDING AND HELIX-FORMING APPARATUS

BACKGROUND OF THE INVENTION

1. Field of the Invention

An apparatus for continuously driving long, flexible or deformable products in order to give them a curvature and especially to make them assume a helical form, with a view to subjecting them to a treatment chamber.

2. Description of the prior art

In order to subject a long product of small section, such as a wire, tube or strip, to a cleaning treatment, a chemical treatment or electrolytic treatment, etc..., it is known to bring this long product into helical form at the inlet end of a chamber in which the treatment is carried out, and to cause it to progress in said chamber by rotation of the helix on itself, this latter being supported by one or more bearing shafts. This method of causing a considerable reduction in the size of the treatment zone ensures that the treatment proceeds with excellent regularity and permits an increase in the speed in the chamber and hence in the output of the treated long product.

Several apparatus exist which permit a product of great length to be brought into helical form. Thus, it is known to use a bending or stamping press, of which the punch and the die have a groove with the desired curvature and a section complementary with that of the long product to be brought to helical form. The press operates intermittently and permits a regularity in curvature to be obtained. On the other hand, the use of such a press presents very many inconveniences; costly tooling, specific to the section of the long product to be formed into a helix; the necessity of greasing the punch and die so as to avoid premature wear, with which there is a risk of causing binding of the product, delicate joining of two lengths of long product, because of the thickness of the joining or butting zone: functioning of the press in fits and starts, and therefore slowly, this making it necessary for the arrangement receiving the helix also to function intermittently; irreversibility of the method, thereby preventing a broken joint to be returned to the front end, where it could be conveniently remade.

It is also known to use a capstan having a smooth drum. The rotation of the capstan on its shaft causes the formation of a succession of turns, the diameter of which is equal to that of the drum. However, in order to avoid the turns overlapping one another, it is essential to impose a first displacement of the capstan along its axis relatively to the initial supply drum and then a rearward return movement at the moment when the last turn being formed is made in the immediate vicinity of the rear face or edge of the drum. The use of a smooth drum capstan therefore involves a complex and heavy installation, and also has the disadvantage that it is irreversible.

It is also known to use a rolling mill having grooved rollers or pulleys, particularly in connection with wire, the functions of driving and bending being respectively assured by different coupled rollers and by one or more rollers, which may or may not be coupled. This apparatus permits a wire of any sectional form to be driven without any danger of deformation, on condition that the coupled rollers or pulleys which ensure the driving action are provided with a groove matching the sectional form. Nevertheless, the driving force is relatively weak, since the contact between wire and roller is only punctiform for each generatrix of the wire, and because the pressure exerted on this wire by coupled driving rollers has to be moderated so as not to crush or flatten it, which could have the disadvantage of altering the shape of its section, so as not to hammer-harden it (unless this should be desirable) and finally so as not to disturb the regularity of the expected bending effect.

An apparatus which functions on the same principle as the roller-type rolling mill is the cylinder-type rolling mill for flat strips. This apparatus permits a strip of any section to be driven, always provided that the table of the cylinder is sufficiently large. It does not present the disadvantage of hammer-hardening as previously mentioned in respect of the groove-type rolling mill. On the other hand, only flat strips or plates can be correctly driven by the cylinder-type rolling mill; such a mill is incapable of driving profiled strips.

A self-locking capstan is also known which acts by one length of wire being pinched by another in a groove, the wire passing over a satellite between its two successive passes in the groove. An apparatus of this type is described in French Pat. No. 1,353,965. Such a capstan gives a wire a practically constant radius of curvature and its tractive force is considerable; it would be sufficient for the wire to be drawn through a wire-drawing die. On the other hand, the following disadvantages are found; only the wires having a round section can be driven, the self-locking capstan being incapable of operating with wires having a square, rectangular, hexagonal or any other section; the self-locking capstan is not reversible and rearward movement is impossible; during the passage of the wire from the capstan to the satellite and then from the satellite to the capstan there is considerable danger of causing cold-rolling of the wire; and gripping and then the loosening of the wire in the groove provides the risk of causing scoring of the surface. Further it is not easy for the wire to be introduced, it being necessary for the first few meters of a ring of wire to be positioned by hand. For this reason, it is necessary to stop the capstan each time a new wire has to be introduced, and at least to solder it end to end with the preceding wire. Furthermore, each time it may be a question of introducing into the installation a new wire which is impossible to join up with the preceding wire, either because of their common nature, or because of their differences as regards nature or section, so that the first few meters of this new wire are engaged manually, first of all on the capstan, then on the satellite, and finally once again on the capstan, without it being possible for them to be brought under regular conditions as regards tension, from which the following meters would benefit. The result is that these first meters leave the capstan with inevitable malformations, so that it is necessary for them to be removed and discarded.

All the apparatus as described above are able to receive long products which are of round or flat sectional form. However, they cannot accept the section members, particularly having a section in the form of a closed curve, some parts of which are concave and some convex. This is their main disadvantage.

SUMMARY OF THE INVENTION

The invention relates to a bending or helix-forming apparatus for long, flexible or deformable products, which has the following advantages:

it may operate continuously.

it may receive wires, whether they are of round, hexagonal, square, rectangular or other sections. It can also receive strips or bands, (whether these are perforated or not), also tubes, (whether these are of circular or other section) and also profiled section members, (whether these are obtained by drawing, rolling, wire-drawing, folding or extrusion) whatever may be their sectional form.

it can also receive products such as those mentioned above, which are deformed and, for example twisted, without having to subject them to a preliminary straightening.

it is reversible and permits rearward travel.

it permits easy adjustment of the curvature to be given to the long product.

it can accept the passage of the contact zone of two different long products placed end to end and connected to one another be welding, sticking, sleeve-coupling or any other means, this being possible, whatever may be the section of the junction zone, which may differ from the overall section resulting from the superimposition of the two terminal elements of the long products.

it can be used independently of the nature of the long product, and thus it can handle, for example, long products made of metal or of synthetic plastics, or products which combine these two materials, such as a steel wire covered with a plastic sheath.

In order to achieve these results, the invention provides for possibly subjecting the long product which is to be bent or formed into a helix to a "pressing by rolling," this pressing occurring when necessary during the bending of the long product around a rotating drum and being the result of the action of at least one loose roller forcing the said long product on to a sector portion of the rim of the said drum around which the product is curved.

A bending or helix-forming apparatus for long, flexible or deformable products according to the invention is then characterised in that it comprises a drum driven in rotation about its axis by driving means, a pair of rollers applying pressure to the long product and mounted loosely or not on shafts parallel to that of the drum, and means for regulating the distance of the pressure rollers from the drum. According to another feature of the invention, the apparatus also comprises a means for guiding the product on the periphery of the drum and interposed between the two pressure rollers. Two solutions are envisaged for guiding the product. A first solution consists in a train of rollers, preferably three rollers, which themselves are also adjustable in distance relatively to the drum. A second solution consists in a flexible belt mounted on rollers, of which at least one is a tension roller, and disposed so as to be in contact with the major part of the periphery of the drum which is between the two pressure rollers. In the case where a belt-type guiding arrangement is employed, it is possible to cause this belt to pass over the first pressure roller.

The drum and/or the pressure rollers preferably have a rim which is formed by a resilient material which is resistant to but capable of elastic deformation, for example rubber. The ability of this rim to be deformed with the introduction of the long product between the pressure rollers and the drum permits the travel and the driving of the long product, whatever may be its section; it is because of this particular feature that the apparatus is able to receive, as already indicated above, section members of all sectional forms as well as wires, bands or tubes.

Commencement of the curvature occurs from the introduction of the long product between the drum and the first pressure roller. The continuance of the rotation of the drum assures the advance of the long product, which is pressed down on the periphery of the drum by the guiding means (rollers or belt) followed by the introduction of the product between the second pressure roller and the drum. The complete curvature is thus given and the long product leaves, forming a succession of helical turns.

The radius of curvature of the turns of the helix can be rapidly regulated during operation, so as to be either reduced or increased, as indicated below.

Reduction in the radius of curvature of the turns of the helix may be obtained by causing the long product, just before it reaches the drum, to pass into a conventional straightening device provided with loose cylindrical pulleys or rollers, disposed in staggered arrangement and with shafts parallel to that of the said drum. The relative arrangement of these pulleys or rollers is such that this straightening or trueing device can give the long product a curvature in the same direction as that which would be given to it by the drum. Under these conditions, and since the long product retains for some time the curvature imparted by the straightening device, this product leaves the drum with a radius of curvature smaller than the intrinsic radius of curvature which the drum would have given to it if the straightening or trueing device were not there. The smaller the radius of curvature given by the straightening or trueing device, the more the final radius of curvature is reduced. This procedure for reduction in radius is of particular interest when it is desired to obtain turns of small diameter, such as may be the case for a wire of small diameter or with a high elastic limit.

Enlargement of the radius of curvature of the helix is obtained by causing the pressure rollers, and more especially the last roller, to penetrate into the flexible rim of the drum, which is then penetrated in the manner of a pneumatic tire passing over a stone. The result thereof is a stamping effect on the long product which is between the pressure roller or rollers and the drum and consequently an effect of enlarging its radius of curvature.

Obviously, if several pressure rollers are used for producing this stamping or pressing effect, the opposite curvatures which they impose on the long product cancel one another out. This is the reason why this pressing or stamping effect result mainly from the action of the last pressure roller and this is why it is called in the following description a "stamping roller" as distinct from the preceding rollers, which will continue to be called "pressure rollers".

Another means for increasing the radius of curvature of the helical turns consists in reversing the relative arrangement of the rollers of the straightening or trueing device as compared with that which they have when it is desired to reduce this radius. In this way, a curvature in a direction opposite to that which would be given by the drum is obtained at the outlet end of the straightening device. However, it is difficult to employ such means, because the disposition of the long product on its arrival at the drum would not permit it to be placed against the latter without distorting it.

The rim of the drum is preferably made of resistant but pliable material having elastic deformation. The rim surface may be smooth or grooved, flat or contoured, and in this latter case may have a channel or a projection in relief.

As already stated above, the bending or helix-forming apparatus according to the invention is particularly designed for feeding a treatment chamber for the long product as thus shaped. In such a chamber, the long product of helix form is supported by one or more horizontal shafts which are driven in rotation and of which the movement ensures the progression of the helix. It is possible to use the upstream end of a shaft-supporting device and cause it to also act as the drum for forming the helix. It is then necessary for this shaft end to be equipped with a flexible rim and to arrange the pressure rollers and the guiding device around it. The helix is then formed directly on the shaft-supporting means.

Several forms of the invention will now be described with reference to the accompanying drawings.

DESCRIPTION OF PREFERRED EMBODIMENTS

Figure 1:
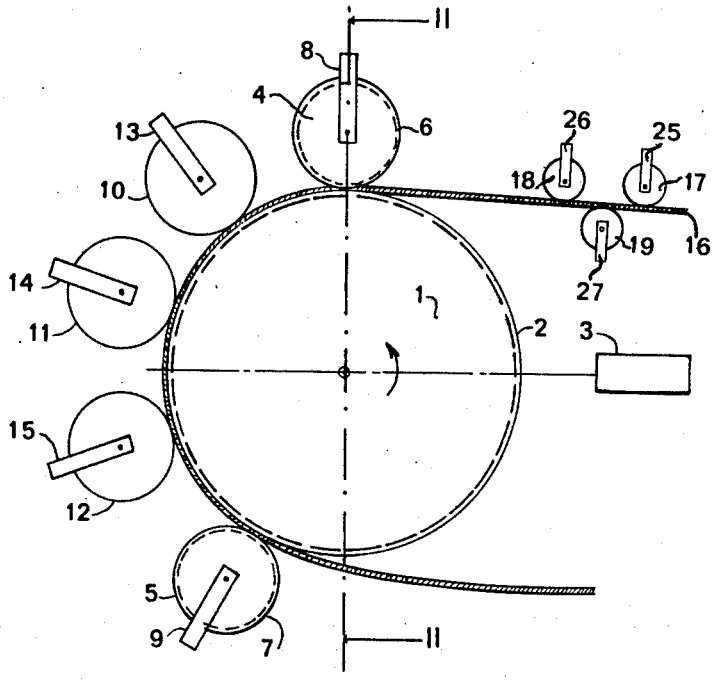
FIG. 1 is a front view of an apparatus for forming a helix by pressure rolling, in accordance with the invention.
Figure 2:
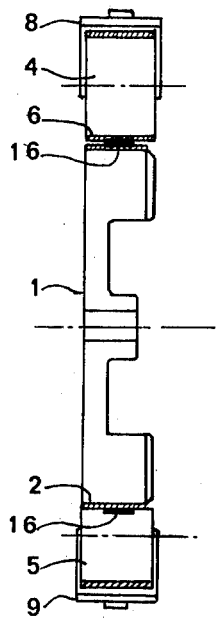
FIG. 2 is a second on the line II—II of FIG. 1.

Shown in FIGS. 1 and 2 is an apparatus which comprises a drum 1, the rim 2 of which consists of flexible material, the drum being driven in rotation by motor means 3.

A pressure roller 4 and a stamping roller 5 are themselves also provided with rims 6 and 7 respectively of flexible material in the embodiment which is illustrated. Independent adjustment means 8 and 9 permit displacement of the rollers 4 and 5 relatively to the drum 1 and thus permit variation in the contact pressure. A guiding arrangement is formed by a train of three rollers or pulleys 10, 11 and 12, each equipped with means 13, 14, 15, respectively, for adjusting their distance from the drum 1.

A long product 16, which may be a wire, a tube, a band or any other section member, is introduced into the apparatus after having passed through a straightening or trueing device represented diagrammatically by three rollers 17, 18 and 19, all three of which can be adjusted by adjustment means 25, 26 and 27 respectively.

By application of a pressure on the stamping roller 5, greater than that which would be sufficient for applying the long product 16 to the flexible rim 2 of the drum (and thus of causing the driving thereof by adherence), there results a penetration in the form of a continuous pressing or stamping of the said long product in the flexible mass of the said rim. The result thereof on the long product 16 is a curving or bending effect which is opposite to that resulting from its earlier application to the drum by the preceding rollers. Thus the long product 16 has its radius of curvature increased, the amount of increase being proportional to the excess pressure applied to roller 5. In practice, it is thus possible to produce, from a single long product, turns which have diameters in the ratio of 1 to 2.

Figure 3:
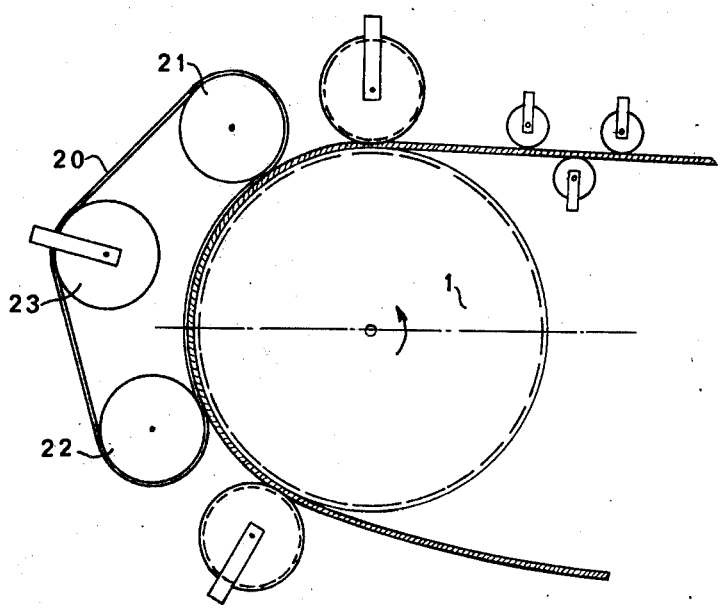
FIGS. 3 and 4 are front views of other embodiments.

FIG. 3 shows an apparatus according to the invention, in which the guiding arrangement is formed by a belt 20 passing over three rollers or pulleys 21, 22, and 23; the pulley 23 is a tensioning pulley for regulating the bearing pressure of the belt on the drum 1.

Figure 4:
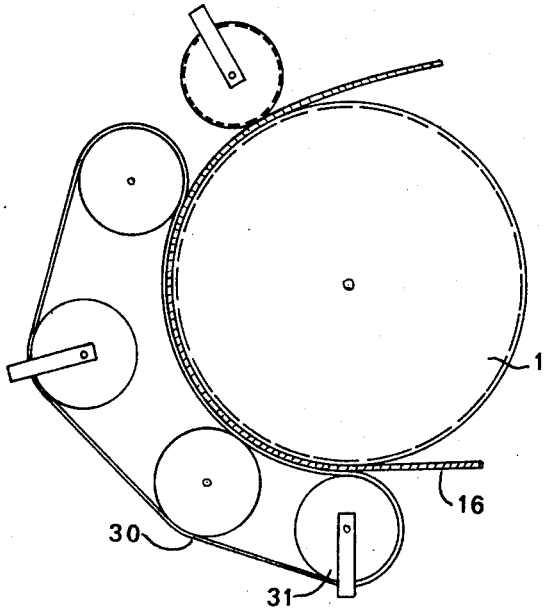

FIG. 4 shows an apparatus according to the invention, in which the guiding arrangement is also a belt, as in the apparatus shown in FIG. 3. In this case, however, the belt 30 passes around the pressure roller 31. Therefore, there is no discontinuity in the guiding of the long product after the latter has passed between the roller 31 and the drum 1.

Figure 5:
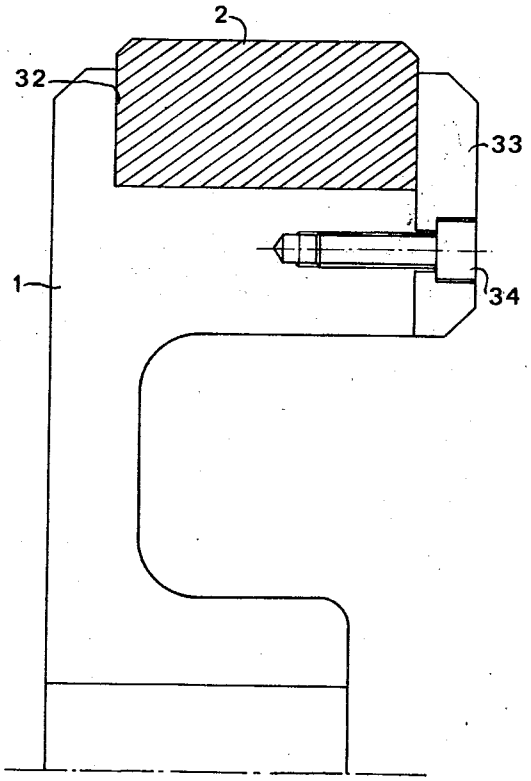
FIG. 5 is a half section of the drum of the apparatus.

FIG. 5 shows the way in which the flexible rim 2 is fixed on the drum 1. It is fitted against a shoulder 32 by a ring 33, which is itself fixed on the drum by threaded bolts 34. In the embodiment shown in FIG. 5, the rim 2 is flat.

Figure 6:
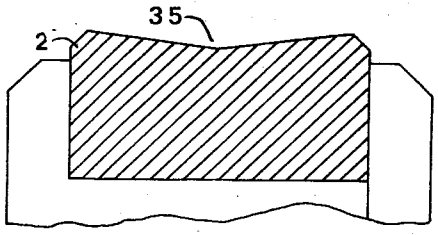
FIGS. 6 to 8 are partial sections of drums, of which the rims have another section than that shown in FIG. 5.

FIG. 6 shows a rim which has a V-shaped depression 35 extending over the full width of the rim.

Figure 7:
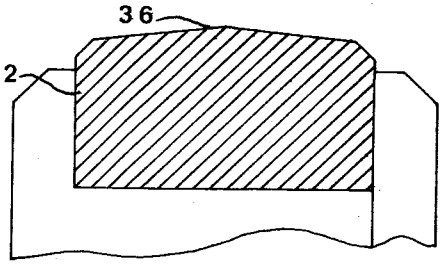

FIG. 7 shows a rim 2 which has a relief protuberance 36 in the form of inverted V, extending over the full width of the rim.

Figure 8:
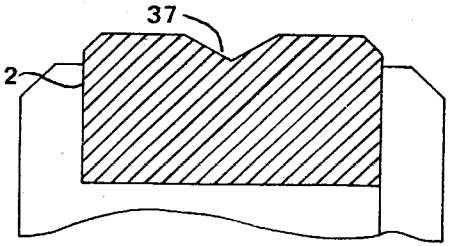

FIG. 8 shows a rim having a V-shaped indentation 37 in the centre of the rim.

When using rims as described in FIGS. 6 to 8, the bearing surface of such rim does not necessarily match every part of the section in respect of each long product.

Figure 9:
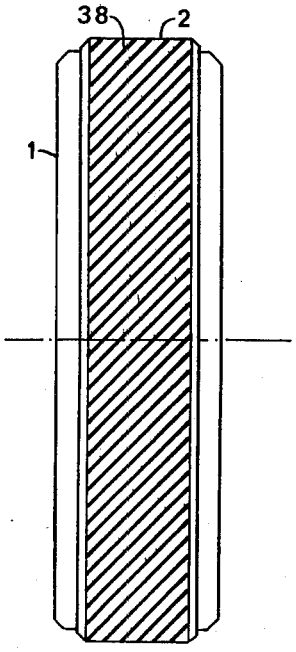
FIG. 9 is a front view of a drum with a grooved rim.

FIG. 9 shows a rim 2 carrying parallel ribs 38.

In the embodiments as illustrated in the foregoing figures, the drum 1 has a diameter considerably larger than that of the pressure rollers 4 and 5. The invention also includes the case, particularly with a wire, in which the diameters of the drum 1 and of the rollers 4 and 5 have dimensions close to one another.

Figure 10:
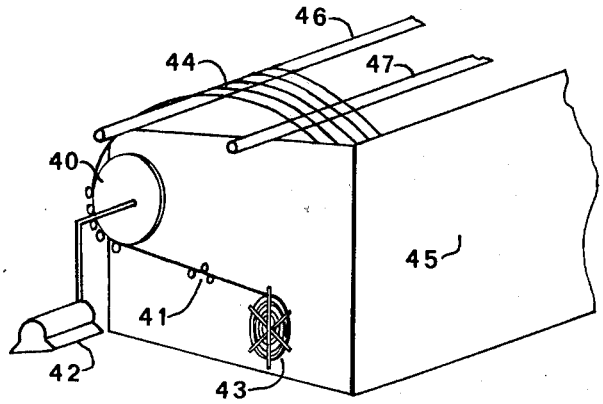
FIG. 10 shows one method of using the apparatus.

FIG. 10 shows a helix-forming apparatus 40, with a trueing device 41, driven by a motor 42. The apparatus is supplied with long product stored on a reel 43. The formed turns 44 pass into a treatment bath contained in a tank 45 and are supported by two parallel shafts 46 and 47. The driving means by which the shafts 46 and 47 are rotated have not been shown.

We claim:

1. Apparatus for bending and imparting a helical shape to an elongate work-piece, comprising: a rotatable drum against which the work-piece is urged to bend the workpiece; at least a first pressure roller adjacent the drum and urged against the drum with a first predetermined pressure to cause the work-piece, fed between the first pressure roller and the drum, to bend to a first radius of curvature; and at least a second pressure roller adjacent the drum and urged against the drum with a second predetermined pressure greater than the first predetermined pressure to bend the previously bend work-piece fed between the second pressure roller and the drum to a radius of curvature different from the first radius of curvature.

2. Apparatus as in claim 1, wherein guide means is adjacent the drum for guiding the work-piece on the drum periphery as the work-piece is fed between the drum and the first and second pressure rollers.

3. Apparatus as in claim 2, wherein the guide means comprises a series of rollers serially arranged around the periphery of the drum between the first and second pressure rollers for sequentially engaging the work-piece and holding it against the drum.

4. Apparatus as in claim 2, wherein the guide means comprises an elongate belt having one flight thereof engaged against the work-piece and drum between the first and second pressure rollers to guide and hold the work-piece against the drum.

5. Apparatus as in claim 4, wherein the belt comprises an endless loop, and at least three guide rollers are disposed adjacent said drum between the first and second pressure rollers, with their axiis parallel to the axis of the drum, two of said guide rollers being contiguous with said work-piece and drum and the other of said guide rollers being spaced from said drum and comprising a tensioning roller for said belt, said belt loop being disposed around said rollers.

6. Apparatus as in claim 4, wherein the belt comprises an endless loop, and at least three guide rollers are disposed adjacent said drum between the first and second pressure rollers, with their axes parallel to the axis of the drum, two of said guide rollers being contiguous with said drum and the other of said guide rollers being spaced from said drum and comprising a tensioning roller for said belt, said belt loop being disposed around one of said pressure rollers and around said guide rollers.

7. Apparatus as in claim 1, wherein said drum has a peripheral covering of pliable material capable of elastic deformation.

8. Apparatus as in claim 7 wherein the covering of pliable material has a fluted bearing surface to the work-piece.

9. Apparatus as in claim 7, wherein the covering of pliable material has a circumferential groove therein for receiving the work-piece.

10. Apparatus as in claim 7, wherein the covering of pliable material has a plurality of parallel ribs thereon extending diagonally to a plane perpendicular to the axis of the drum.

11. Apparatus as in claim 7, wherein the covering of pliable material has a convex bearing surface to the work-piece.

12. Apparatus as in claim 1, wherein a plurality of parallel rollers are arranged in staggered relationship in advance of the drum for straightening a work-piece fed to the drum.

13. Apparatus as in claim 7, wherein at least one of the pressure rollers has a peripheral covering of pliable material capable of elastic deformation.

14. Apparatus as in claim 7, wherein the second pressure roller engages the work-piece with a pressure sufficient to press the work-piece into the pliable covering, whereby the bending affect on the work-piece of the second pressure roller is opposite to that imparted by the first pressure roller and the radius of curvature of the work-piece is thus increased.

* * * * *

UNITED STATES PATENT AND TRADEMARK OFFICE

CERTIFICATE OF CORRECTION

PATENT NO. : 4,145,904

DATED : March 27,1979

INVENTOR(S) : Marcel A.GIROS et al

It is certified that error appears in the above-identified patent and that said Letters Patent are hereby corrected as shown below:

Assignee's name to read: -- Societe Meusienne de Constructions Mecaniques --

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*